US007601433B2

(12) United States Patent
Kitsuwa

(10) Patent No.: US 7,601,433 B2
(45) Date of Patent: Oct. 13, 2009

(54) HIGHLY CORROSION-RESISTANT/HIGHLY WORKABLE PLATED STEEL WIRE, PLATING BATH COMPOSITION, METHOD FOR PRODUCING THE PLATED STEEL WIRE AND WIRE NETTING PRODUCT

(75) Inventor: Tomio Kitsuwa, Osaka (JP)

(73) Assignee: Sakuratech Co., Ltd., Osaka (JP)

( * ) Notice: Subject to any disclaimer, the term of this patent is extended or adjusted under 35 U.S.C. 154(b) by 542 days.

(21) Appl. No.: 11/294,483

(22) Filed: Dec. 6, 2005

(65) Prior Publication Data

US 2006/0141280 A1 Jun. 29, 2006

(30) Foreign Application Priority Data

Dec. 28, 2004 (JP) ..... 2004-378626

(51) Int. Cl.
*B32B 15/02* (2006.01)
*C23C 2/06* (2006.01)
*C23C 2/38* (2006.01)

(52) U.S. Cl. ..... 428/607; 428/659; 428/939

(58) Field of Classification Search ..... None
See application file for complete search history.

(56) References Cited

U.S. PATENT DOCUMENTS 7,267,890 B2 * 9/2007 Fujita et al. ..... 428/659
2003/0175549 A1 * 9/2003 Fujimoto et al. ..... 428/659
2005/0147832 A1 * 7/2005 Okai et al. ..... 428/447
2006/0141230 A1 * 6/2006 Miyoshi et al. ..... 428/216

FOREIGN PATENT DOCUMENTS

| | | | |
|---|---|---|---|
| JP | 56-108845 | * | 8/1981 |
| JP | 56-108846 | * | 8/1981 |
| JP | 59-001670 | | 1/1984 |
| JP | 61-179861 | * | 8/1986 |
| JP | 2-153058 | * | 6/1990 |
| JP | 3-68749 | * | 3/1991 |
| JP | 3-75347 | * | 3/1991 |
| JP | 4-276057 | * | 10/1992 |
| JP | 5-287485 | * | 11/1993 |
| JP | 06-287735 | | 10/1994 |
| JP | 6-287735 | * | 10/1994 |
| JP | 07-278772 | * | 10/1995 |
| JP | 2001-207250 | | 7/2001 |
| JP | 2004-263268 | * | 9/2004 |
| JP | 2005-194551 | | 7/2005 |

* cited by examiner

*Primary Examiner*—John J Zimmerman
(74) *Attorney, Agent, or Firm*—Squire, Sanders & Dempsey L.L.P.

(57) ABSTRACT

A plated steel wire having a plated layer and an intermediate layer is characterized in that a content of manganese contained in both the plated layer and the intermediate layer is 0.02-0.30% in terms of average mass percentage, a content of aluminum is 8-25% in terms of average mass percentage, and a content of zinc and inevitable components is 74.70-91.98% in terms of average mass percentage, and that a total deposition amount of the intermediate layer and the plated layer per unit area of the steel wire surface is set to 700-1000 g/m$^2$. The plated steel wire has excellent corrosion resistance and excellent workability, with the increased total deposition amount of the plated layer and the intermediate layer.

10 Claims, 13 Drawing Sheets

ϕ4.0mm 0.21%Mn-12.1%Al-87.69% (Zn+INEVITABLE COMPONENTS)
WATER-COOLING

CROSS-SECTIONAL PICTURE OF METALLOGRAPHIC STRUCTURE (×400)

ϕ4.0mm 0.21%Mn-12.1%Al-87.69% (Zn+INEVITABLE COMPONENTS)
AIR-COOLING

CROSS-SECTIONAL PICTURE OF METALLOGRAPHIC STRUCTURE (×400)

ϕ 4.0mm 0.30%Mn-11.8%Al-87.9% (Zn+INEVITABLE COMPONENTS)
WATER-COOLING

CROSS-SECTIONAL PICTURE OF METALLOGRAPHIC STRUCTURE (×400)

ϕ 4.0mm 0.30%Mn-11.8%Al-87.9% (Zn+INEVITABLE COMPONENTS)
AIR-COOLING

CROSS-SECTIONAL PICTURE OF METALLOGRAPHIC STRUCTURE (×400)

ϕ 4.0mm 11.8%Al-88.2% (Zn+INEVITABLE COMPONENTS)

WATER-COOLING

CROSS-SECTIONAL PICTURE OF METALLOGRAPHIC STRUCTURE (×400)

ϕ 4.0mm 11.8%Al-88.2% (Zn+INEVITABLE COMPONENTS)

AIR-COOLING

CROSS-SECTIONAL PICTURE OF METALLOGRAPHIC STRUCTURE (×400)

0.21%Mn-12.1%Al-87.69% (Zn+INEVITABLE COMPONENTS) PLATED STEEL WIRE
$\phi$ 4.0mm, AIR-COOLING, EPMA ANALYSIS 0.48%Sn-11.8%Al-87.72% (Zn+INEVITABLE COMPONENTS) PLATED STEEL WIRE
$\phi$ 4.0mm, WATER-COOLING, EPMA ANALYSIS 0.46%Mg-12.0%Al-87.54% (Zn+INEVITABLE COMPONENTS) PLATED STEEL WIRE
$\phi$ 4.0mm, WATER-COOLING, EPMA ANALYSIS 0.27%Si-12.1%Al-87.63% (Zn+INEVITABLE COMPONENTS) PLATED STEEL WIRE
$\phi$ 4.0mm, AIR-COOLING, EPMA ANALYSIS

HIGHLY CORROSION-RESISTANT/HIGHLY WORKABLE PLATED STEEL WIRE, PLATING BATH COMPOSITION, METHOD FOR PRODUCING THE PLATED STEEL WIRE AND WIRE NETTING PRODUCT

CROSS-REFERENCE TO RELATED APPLICATIONS

This application claims the foreign priority benefit under Title 35, United States Code, § 119 (a)-(d), of Japanese Patent Application No. 2004-378626, filed on Dec. 28, 2004 in the Japan Patent Office, the disclosure of which is herein incorporated by reference in its entirety.

BACKGROUND OF THE INVENTION

1. Field of the Invention

The present invention relates to a plated steel wire having enhanced corrosion resistance and enhanced workability useful for various wire netting products to be used outdoors, such as wire fabric container for revetment (shore protection), wire netting, safety net and the like.

2. Description of the Related Art

Conventionally, as a zinc-aluminum alloy plated steel wire, a steel wire having a plated layer containing magnesium of 0.8-5% by weight has been known (see, for example, Japanese Patent Application JP2001-207250A, paragraphs 0018-0019). The presence of the magnesium in the plated layer gives the plated steel wire excellent corrosive resistance. In this zinc-aluminum alloy plated steel wire, a hard intermediate layer (zinc-aluminum-magnesium intermediate layer) is formed between the plated layer and the steel wire, and hardness of the resultant plated steel wire becomes high. Therefore, from the viewpoint of workability, it is desired that the thickness of the intermediate layer be 20 μm or less, and that the total deposition amount of the plated layer and the intermediate layer per unit area of the steel wire surface be approximately 220-280 g/m$^2$.

However, there remains a problem in that the workability is poor, even though the thickness of the intermediate layer is reduced, since the hardness of the plated layer is excessively high.

In addition, a method for producing a plated steel wire having a total deposition amount of the intermediate layer and the plated layer per unit area of the steel wire surface of 700 g/m$^2$ or more has not been developed and it has been widely conceived that to obtain such a plated steel wire is extremely difficult.

Therefore, it would be desirable to provide a plated steel wire having excellent corrosive resistance and excellent workability with the total deposition amount of the intermediate layer and the plated layer being increased; a plating bath composition for producing such a plated steel wire; a method for producing such a plated steel wire; and a wire netting product formed of such a plated steel wire.

Illustrative, non-limiting embodiments of the present invention overcome the above disadvantages and other disadvantages not described above.

SUMMARY OF THE INVENTION

In one aspect of the present invention, a corrosion-resistant and workable plated steel wire is provided which includes a steel wire; a plated layer containing zinc, aluminum and manganese; and an intermediate layer containing zinc, aluminum and manganese, the intermediate layer being sandwiched between the steel wire and the plated layer, wherein a content of manganese contained in both the plated layer and the intermediate layer is 0.02-0.30% in terms of average mass percentage, a content of aluminum is 8-25% in terms of average mass percentage, and a content of zinc and inevitable components is 74.70-91.98% in terms of average mass percentage. It is preferred that a total deposition amount of the intermediate layer and the plated layer per unit area of the steel wire surface be set to 700-1000 g/m2.

Since both the plated layer and the intermediate layer of the plated steel wire contain the above-mentioned predetermined percentages of manganese, aluminum and zinc in, the plated steel wire exhibits excellent corrosion resistance and workability, as compared with the conventional zinc-aluminum alloy plated steel wire, i.e. plated steel wire having a plated layer consisting solely of a zinc-aluminum alloy (plated steel wire having a zinc-aluminum alloy plated layer with no additive) or zinc-aluminum-magnesium alloy plated steel wire.

Since the total deposition amount of the intermediate layer and the plated layer per unit area of the steel wire surface is set to 700-1000 g/m$^2$, the plated steel wire exhibits excellent corrosion resistance as compared with the conventional plated steel wires having the total deposition amount of less than 700 g/m$^2$.

As a result of augmentation of the plated layer and the intermediate layer of the plated steel wire, the total thickness of the plated layer and the intermediate layer may become approximately 100-140 μm, for example. For this reason, the plated steel wire of the present invention exhibits improved abrasion resistance as compared with the conventional plated steel wires. Therefore, the plated steel wire of the present invention is suitable as a material for, for example, wire fabric container for revetment which is to be exposed to sand and the like.

With respect to this corrosion-resistant and workable plated steel wire, it is preferable that the concentration of the manganese be uniform throughout the plated layer and the intermediate layer, Vickers hardness of the plated layer be 45-65, and Vickers hardness of the intermediate layer be 50-70. In such a plated steel wire, since the concentration of manganese is uniform throughout the plated layer and the intermediate layer, and the plated layer and the intermediate layer are approximate to each other in hardness, generation of cracks in the plated layer and the intermediate layer is prevented when the plated steel wire is subjected to, for example, bending processing.

It is preferred that the corrosion-resistant and workable plated steel wire have eutectoid of zinc, aluminum and manganese dispersed in the matrix of the plated layer. In this corrosion-resistant and workable plated steel wire, masses of eutectoid, which is generally susceptible to corrosion, are dispersed in the matrix, so that each mass of eutectoid is surrounded by the matrix. Therefore, the plated steel wire 1 has excellent corrosion resistance as compared with the plated steel wire in which eutectoid is homogeneously dispersed in the matrix.

In another aspect of the present invention, a plating bath composition is provided which includes 0.04-0.60 percentage by mass of manganese, 7.00-24.00 percentage by mass of aluminum and 75.40-92.96 percentage by mass of zinc and inevitable components.

In the present invention, the presence of the predetermined ratio of manganese lowers the fluidity of the plating bath composition. As a result, with the use of such a plating bath composition, the total deposition amount of the intermediate layer and the plated layer onto the steel wire can be increased.

It should be noted that, with the use of the conventional plating bath composition, it is impossible to obtain a plated steel wire having the total deposition amount of the intermediate layer and the plated layer per unit area of the steel wire surface of 700 g/m$^2$ or more. In contrast, with the use of the plating bath composition of the present invention, a corrosion-resistant and workable plated steel wire having the total deposition amount of the intermediate layer and the plated layer of approximately 1000 g/m$^2$ can be obtained.

In another aspect of the present invention, a method for producing a corrosion-resistant and workable plated steel wire is provided which includes: a plating bath composition preparing step in which a plating bath composition containing zinc, aluminum and manganese is prepared in such a manner that the manganese content becomes 0.04-0.60 percentage by mass; and a plating step in which a steel wire is immersed in the plating bath composition to thereby form a plated layer containing zinc, aluminum and manganese on the steel wire, and an intermediate layer containing zinc, aluminum and manganese, the intermediate layer being sandwiched between the steel wire and the plated layer.

In this production method, the presence of the predetermined ratio of manganese in the plating bath composition lowers the fluidity of the plating bath composition. As a result, this production method can remarkably increase the total deposition amount of the plated layer and the intermediate layer on the steel wire.

It is preferable that, in the above-mentioned method, a total deposition amount of the plated layer and the intermediate layer per unit area of the steel wire surface be set to 700-1000 g/m$^2$.

In such a production method, it is desirable that manganese be localized in the upper layer of the plating bath composition. In this production method, by localizing manganese in the upper layer of the plating bath composition, the fluidity of the upper layer of the plating bath composition is lowered. As a result, this production method can remarkably increase the total deposition amount of the intermediate layer and the plated layer onto the steel wire.

In this method for producing corrosion-resistant and workable plated steel wire, a steel wire is immersed in the plating bath composition containing zinc, aluminum and manganese, and a plated layer containing zinc, aluminum and manganese is formed over the steel wire with the intermediate layer containing zinc, aluminum and manganese being sandwiched therebetween. The manganese content of this plating bath composition can be adjusted to 2-5 times the manganese content of the plated layer and the intermediate layer of the plated steel wire to be produced.

In general, a part of the metal additive in the plating bath composition to be used for forming a plated layer may form segregation or top dross which is to be removed. As a result, the content of the metal additive in the plating bath composition contained in the plating bath in which a steel wire is to be immersed is decreased. In the production method according to the present invention, lowering of the manganese ratio due to the above-mentioned top dross formation or the like is compensated, since the manganese (metal additive) content is adjusted to 2-5 times the manganese content of the plated layer and the intermediate layer of the plated steel wire to be produced, as described above. For this reason, with the use of this production method, the corrosion-resistant and workable plated steel wire having the intermediate layer and the plated layer containing the above-mentioned predetermined ratio of manganese can be stably produced.

In another aspect of the present invention, a wire netting product is provided which is formed of corrosion-resistant and workable plated steel wire mentioned above. Since the plated steel wire exhibiting excellent workability and corrosion resistance is used, the wire netting product with higher corrosion resistance can be produced easily as compared with the wire netting product made of the conventional plated steel wire. In the corrosion-resistant and workable plated steel wire to be used for this wire netting product, the total deposition amount of the plated layer and the intermediate layer is increased and thus the plated steel wire exhibits excellent abrasion resistance as compared with the conventional plated steel wire, as mentioned above. For this reason, the wire netting product of the present invention exhibits excellent abrasion resistance.

In another aspect of the present invention, a basket made of wire netting is provided in which at least an upper face thereof is formed of the corrosion-resistant and workable plated steel wire mentioned above.

Since the plated steel wire exhibiting excellent workability and corrosion resistance is used, the wire netting basket with higher corrosion resistance can be produced easily as compared with the wire netting basket formed of the conventional plated steel wire. Since the upper face of the wire netting basket is formed of the corrosion-resistant and workable plated steel wire, the upper face exhibits excellent abrasion resistance. The wire netting basket can be used as, for example, wire fabric container for revetment, gabion box, round gabion, gabion mattress for harbor banking and the like.

BRIEF DESCRIPTION OF THE DRAWINGS

The various aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

A corrosion-resistant and workable plated steel wire (hereinbelow, frequently and simply referred to as "plated steel wire"), a method for producing the plated steel wire, and a basket made of wire netting (wire netting product) formed of the plated steel wire, according to embodiments of the present invention will be described in detail with reference to the drawings.

(Plated Steel Wire)

Figure 1:
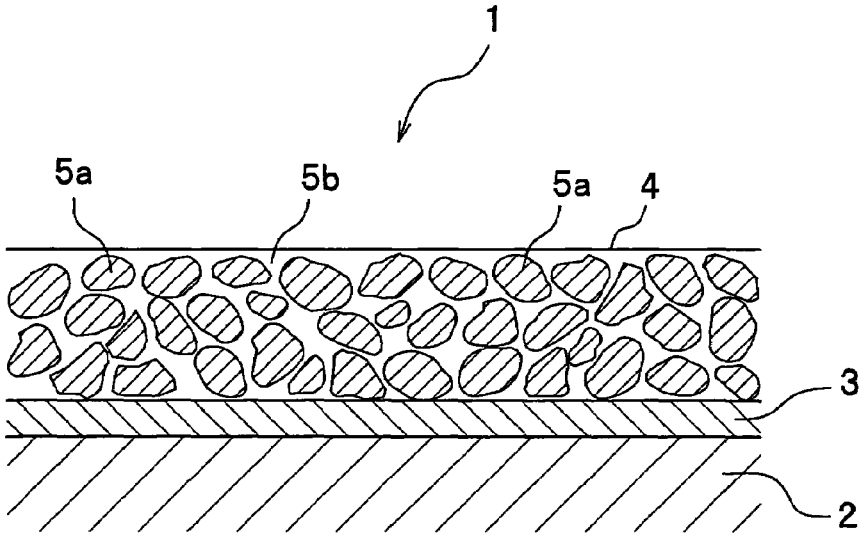
FIG. 1 is a cross section of a part of a plated steel wire according to an embodiment of the present invention.

Referring to FIG. 1, a plated steel wire 1 is formed of a steel wire (base metal) 2, an intermediate layer 3 containing zinc, aluminum and manganese on the plated steel wire 1, and a plated layer 4 including zinc, aluminum and manganese on the intermediate layer 3.

For the steel wire 2, a conventional steel wire, either a mild steel wire or a hard steel wire, can be used. A diameter of the steel wire 2 may be approximately 3.2-10.0 mm. In addition, the steel wire 2 may be one to which a primary plating, such as zinc plating, has been applied.

The intermediate layer 3 is formed of a zinc-aluminum-manganese alloy containing zinc, aluminum and manganese derived from a plating bath composition which will be described below. The intermediate layer 3 further contains inevitable components, such as phosphorus and sulfur, that has been diffused from the steel wire 2. In this embodiment, Vickers hardness of the intermediate layer 3 is 50-70.

The plated layer 4 is formed of a zinc-aluminum-manganese alloy consisting of zinc, aluminum and manganese, which is obtained by solidifying metal components contained in a plating bath composition which will be described below. The plated layer 4 also includes lead, iron, cadmium and the like as inevitable components, which have been present as impurities in zinc. In the plated layer 4, as shown in FIG. 1, the masses of eutectoid 5*a* of zinc, aluminum and manganese are dispersed in the matrix 5*b*. In this embodiment, Vickers hardness of the plated layer 4 is 45-65.

The total deposition amount of the intermediate layer 3 and the plated layer 4 is set to 700-1000 g/m$^2$, in terms of the total deposition amount of the intermediate layer 3 and the plated layer 4 per unit area of the surface of the steel wire 2. The concentration of manganese is uniform throughout the intermediate layer 3 and the plated layer 4, and manganese is homogeneously dispersed in both the intermediate layer 3 and the plated layer 4.

The manganese content of the intermediate layer 3 and the plated layer 4 is 0.02-0.30% in terms of average mass percentage. The aluminum content of the intermediate layer 3 and the plated layer 4 is 7.00-24.00% in terms of average mass percentage, and the content of zinc and inevitable components is 75.40-92.96% in terms of average mass percentage. When the manganese content is below the lower limit of the above-mentioned range, corrosion resistance of the obtained plated steel wire 1 may not be sufficiently improved. When the manganese content is above the upper limit, corrosion resistance of the plated steel wire 1 obtained by air-cooling, which will be described below, may not be sufficiently improved, while workability of the plated steel wire 1 obtained by water-cooling, which will be described below, may become poor.

Since both the intermediate layer 3 and the plated layer 4 of the plated steel wire 1 include manganese, aluminum and zinc in the predetermined ratios mentioned above, the plated steel wire 1 has excellent corrosion resistance as compared with the conventional zinc-aluminum alloy plated steel wire, i.e. plated steel wire having a plated layer including a zinc-aluminum alloy alone (plated steel wire having a plated layer composed of a zinc-aluminum alloy including no additives). Since the intermediate layer 3 and the plated layer 4 of the plated steel wire 1 have hardness equivalent to that of the conventional plated layer composed of a zinc-aluminum alloy alone, the plated steel wire 1 has excellent workability as compared with the conventional zinc-aluminum-magnesium alloy plated steel wire. To sum up, the plated steel wire 1 according to this embodiment is excellent in both corrosion resistance and workability, as compared with the conventional plated steel wire.

In addition, in this plated steel wire 1, the masses of eutectoid 5*a*, which is generally susceptible to corrosion, are dispersed in the matrix 5*b*, so that each mass of eutectoid 5*a* is surrounded by the matrix 5*b*. Further in the plated steel wire 1, the spacing between the individual mass of eutectoid 5*a* separated by matrix 5*b* becomes larger than the spacing in the case where fine particles of eutectoid 5*a* is homogeneously dispersed in the matrix 5*b*. As a result, spread of corrosion becomes difficult and thus the plated steel wire 1 has excellent corrosion resistance.

In addition, in this plated steel wire 1, the total deposition amount of the intermediate layer 3 and the plated layer 4 on the steel wire 2 is set to 700-1000 g/m$^2$. Therefore, the plated steel wire 1 has excellent corrosion resistance as compared with the conventional zinc-aluminum alloy plated steel wire, in which the total deposition amount of the intermediate layer 3 and the plated layer 4 is less than 700 g/m$^2$.

Since the total deposition amount of the intermediate layer 3 and the plated layer 4 on the steel wire 2 in this plated steel wire 1 is set to 700-1000 g/m$^2$, the total thickness of the intermediate layer 3 and the plated layer 4 becomes approximately 100-140 μm. For this reason, the plated steel wire 1 exhibits improved abrasion resistance as compared with the conventional plated steel wires. In addition, on the surface of the plated steel wire 1, irregularities can be easily formed by deformation processing, such as roller processing. The plated steel wire 1 having surface irregularities is suitable as a material for wire fabric container for revetment, since the upper face of such container requires anti-slip property.

(Method for Producing Plated Steel Wire)

The plating bath composition of the present invention will be explained in detail below, along with a method for producing the plated steel wire 1 according to the present embodiment.

The method for producing the plated steel wire 1 includes a plating bath composition preparing step in which a plating bath composition containing zinc, aluminum and manganese is prepared in such a manner that the manganese content becomes 0.04-0.60 percentage by mass; and a plating step in which the above-mentioned steel wire 2 is immersed in the plating bath composition to thereby form a plated layer 4 including zinc, aluminum and manganese on the steel wire 2, and an intermediate layer 3 containing zinc, aluminum and manganese, the intermediate layer being sandwiched between the steel wire 2 and the plated layer 4.

The plating bath composition includes 0.04-0.60% by mass of manganese, 7.00-24.00% by mass of aluminum and 75.40-92.96% by mass of zinc and inevitable components. Examples of the inevitable components include metals that have been present as impurities in zinc, such as lead, iron and cadmium. When the ratio of each metal (manganese, aluminum and zinc) is above the respective upper limit of the above-mentioned range, the amount of top dross metal may increase, and the top dross metal should be frequently removed from the plating bath. The frequent removal results in loss of working efficiency in the plated steel wire production and increase in loss amount of the metal, which in turn leads to increase in cost for the plated steel wire production. When the ratio of each metal is below the respective lower limit, the plated steel wire 1 having the intermediate layer 3 and the plated layer 4 containing the metals in the above-mentioned predetermined amounts may not be obtained.

In this embodiment, the manganese content of the plating bath composition is adjusted to 2-5 times the manganese content of the intermediate layer 3 and the plated layer 4 of the plated steel wire 1 to be produced.

Figure 2:
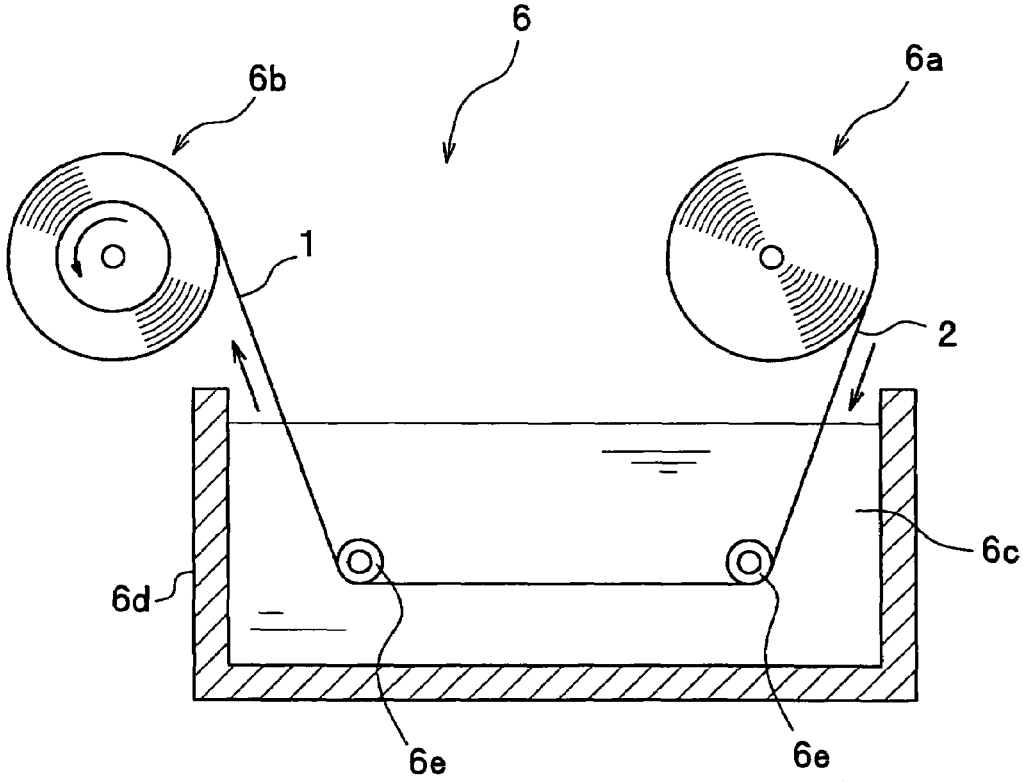
FIG. 2 is a diagram of a production device for producing the plated steel wire of FIG. 1.

A device of the present embodiment for producing plated steel wire to be used in the pleating process will be briefly explained below. Referring to FIG. 2, the plated steel wire production device 6 has a steel wire roll 6*a* for feeding a steel wire 2 to be plated; a plated steel wire roll 6*b* for winding the plated steel wire 1 to which pleating has been applied; a plating bath 6*d* in which a plating bath composition 6*c* is pooled; and guide rollers 6*e* for guiding the steel wire 2 in the plating bath 6*d*. The plated steel wire production device 6 has also a cooling device (not shown) for cooling the plated steel wire 1 pulled out from the plating bath 6*d*. The structure of this cooling device may be a conventional one, and may be of either air-cooling or water-cooling.

In this plated steel wire production device 6, the steel wire 2 fed from the steel wire roll 6*a* is immersed in the plating bath composition 6*c* contained in the plating bath 6*d*, and the plated steel wire 1 is wound up by the plated steel wire roll 6*b*. When the steel wire 2 is pulled out from the plating bath 6*d*, the plating bath composition 6*c* attached to the steel wire 2 is cooled with a cooling device (not shown). As a result, an intermediate layer 3 and the plated layer 4 (see FIG. 1) are formed on the steel wire 2. The pull-out speed of the steel wire 2 from the plating bath 6*d* can be appropriately set depending on total deposition amount of the intermediate layer 3 and the plated layer 4 onto the steel wire 2. The temperature of the plating bath composition 6*c* in the plating bath 6*d* may be approximately 440-460° C.

In such a method for producing plated steel wire 1, the steel wire 2 treated with the plating bath composition 6*c* and pulled out from the plating bath 6*d* (i.e. plated steel wire 1) may be cooled either by air-cooling or by water-cooling. Use of either air-cooling or water-cooling can make it possible to obtain a plated steel wire 1 having a plated layer 4 in which the masses of eutectoid 5*a* are dispersed in a matrix 5*b*. It should be noted that masses of eutectoid 5*a* cannot be obtained in the matrix 5*b*, if water-cooling is applied to the conventional method for producing plated steel wire.

As mentioned above, in the method for producing plated steel wire 1, the steel wire 2 pulled out from the plating bath 6*d* (plated steel wire 1) may be cooled either by air or water. However, water-cooling is desirable since the speed of cooling the plating bath composition 6*c* on the steel wire 2 is faster.

In the above-described method for producing plated steel wire 1, the plating bath composition 6*c* contains manganese in a predetermined ratio as mentioned above. For this reason, the fluidity of the plating bath composition 6*c* becomes lower than that of the conventional zinc-aluminum type plating bath composition containing no manganese. As a result, in this method for producing plated steel wire 1, the amount of the plating bath composition 6*c* deposited on the steel wire 2 is increased. In other words, in this method for producing plated steel wire 1, the total deposition amount of the intermediate layer and the plated layer onto the steel wire 2 can be increased. In the case of the conventional zinc-aluminum alloy plated steel wire, the total deposition amount of the intermediate layer and the plated layer is no more than 700 $g/m^2$ per unit area of the steel wire surface. In contrast, in the case of the plated steel wire 1 obtained by using the plating bath composition 6*c* mentioned above, approximately 1000 $g/m^2$ of the total deposition amount of the intermediate layer 3 and the plated layer 4 can be attained.

In addition, in this method for producing plated steel wire 1, the manganese content of the plating bath composition 6*c* is adjusted to 2-5 times the manganese content of the intermediate layer 3 and the plated layer 4 of the plated steel wire 1 to be produced. Therefore in this production method, manganese is localized in the upper layer of the plating bath composition 6*c*. For this reason, the fluidity of the upper layer of the plating bath composition 6*c* is lowered, and as a result, this production method can remarkably increase the total deposition amount of the intermediate layer 3 and the plated layer 4 onto the steel wire 2.

Furthermore, in this method for producing plated steel wire 1, the manganese content of the plating bath composition 6*c* is adjusted to 2-5 times the manganese content of the intermediate layer 3 and the plated layer 4 of the plated steel wire 1 to be produced, as mentioned above. Since the manganese content of the plating bath composition 6*c* is adjusted to 2-5 times in this method, lowering of the manganese ratio due to top dross formation or segregation in the plating bath composition 6*c* is compensated. For this reason, with the use of this production method, the plated steel wire 1 having the intermediate layer 3 and the plated layer 4 containing the above-mentioned predetermined ratio of manganese can be stably produced.

In this production method, cooling speed of the plating bath composition 6*c* deposited on the steel wire 2 can be augmented by selecting water-cooling. For this reason, it becomes possible to shorten the distance from the bath surface to the plated steel wire roll 6*b* for winding up the plated steel wire 1 from the plating bath composition 6*c*. In other words, the height position of what is called a top roller can be set low, which allows downsizing of the plated steel wire production device 6. As a result, setting of the steel wire 2 (plated steel wire 1) onto the wire pathway for the steel wire 2 (plated steel wire 1) in the plated steel wire production device 6, i.e. workability of setting the wire, is facilitated.

(Wire Netting Basket)

A basket made of wire netting as a wire netting product formed of plated steel wire 1 according to the present embodiment will be described below.

Figure 3A:
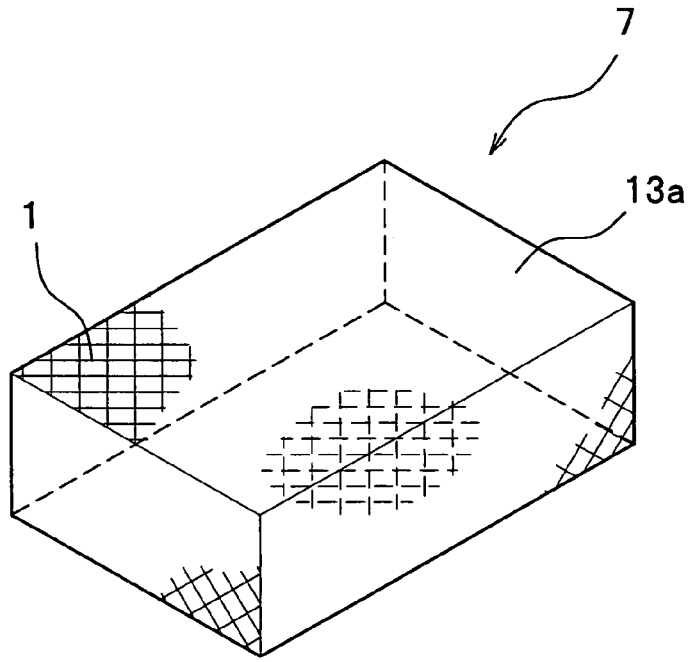
FIGS. 3A and 3B are perspective views of wire netting baskets according to embodiments of the present invention.

A shown in FIG. 3A, a basket 7 according to the present embodiment is a box-shaped body made of wire netting, and only the wire netting making up the upper face 13*a* is made of the plated steel wire 1. Since the upper face 13*a* of the wire netting basket 7 is made of the plated steel wire 1, the basket has excellent abrasion resistance on the upper face 13*a*.

Figure 3B:
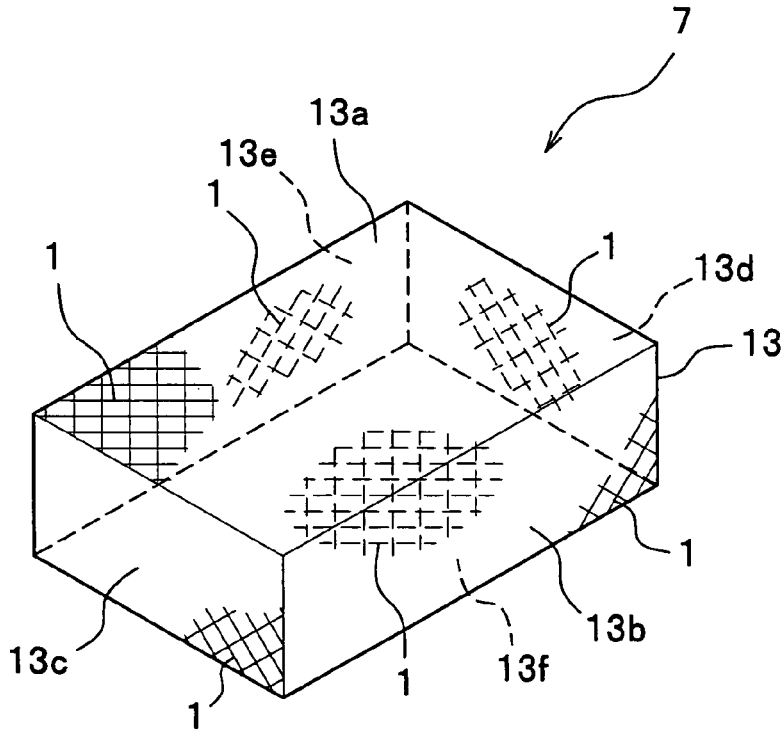

Alternatively, as shown in FIG. 3B, all the wire netting faces of the basket 7, including a front face 13*b*, a left side face 13*c*, a right side face 13*d*, a back face 13*e*, an upper face 13*a* and a bottom face 13*f*, may be formed of plated steel wire 1.

The plated steel wire 1 used for these wire netting baskets 7 is excellent in workability and corrosion resistance as mentioned above. Therefore, the wire netting baskets 7 having higher corrosion resistance can be easily manufactured from the plated steel wire 1, as compared with a wire netting basket utilizing the conventional plated steel wire.

The embodiment of the present invention has been described above. However, the present invention is not limited to the above embodiment, and it is a matter of course that the above embodiment may be properly modified.

In the above-mentioned embodiment, the wire netting basket is in a box shape, though there is no limitation with respect to the shape of the basket of the present invention. Examples include a wire fabric container generally used for revetment which is to be filled with stones, e.g. gabion, gabion box, round gabion and gabion mattress for harbor banking. With respect to these wire netting baskets, a part of the basket may be formed of the plated steel wire 1, or the entire basket may be formed of the plated steel wire 1.

Next, the plated steel wire and the method for producing the same according to the present embodiment will be described in further detail below, with reference to Examples.

EXAMPLES 1-5

In each of Examples 1-5, a plating bath composition was prepared by adding a predetermined amount of manganese to a zinc-aluminum molten composition containing 11.8% by mass of aluminum, so that the plating bath composition contains manganese (represented by "Mn" in Table 1) in the ratio shown in Table 1 below.

An iron wire on which zinc had been deposited as a primary plating was used as a steel wire (diameter: 4 mm). This steel wire was immersed for 8 seconds in the plating bath composition prepared in advance (bath temperature: 450° C.), and pulled out from the plating bath. The cooling of the plating bath composition deposited on the steel wire (plated steel wire) was conducted both by water-cooling and by air-cooling.

Figure 4A:
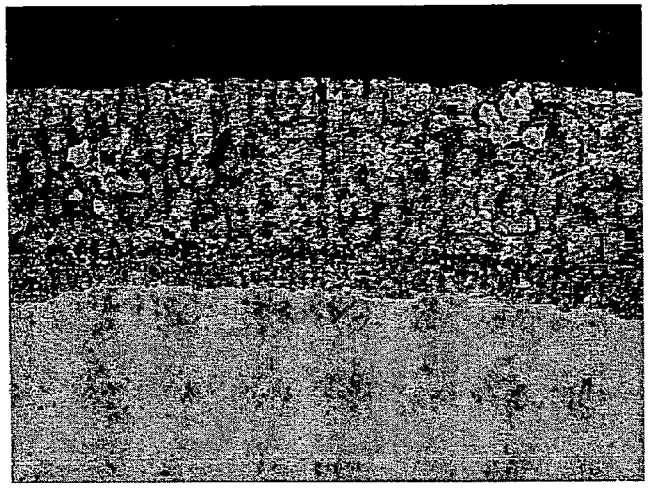
FIG. 4A is a photomicrograph of a cross section of a plated steel wire obtained by water-cooling in Example 4.
Figure 4B:
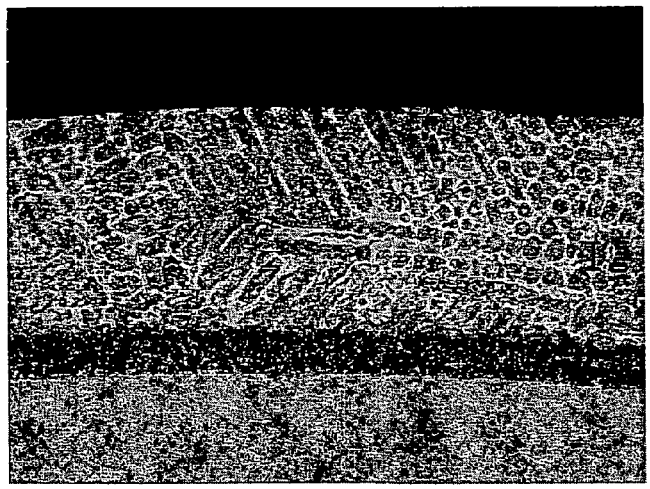
FIG. 4B is a photomicrograph of a cross section of a plated steel wire obtained by air-cooling in Example 4.
Figure 5A:
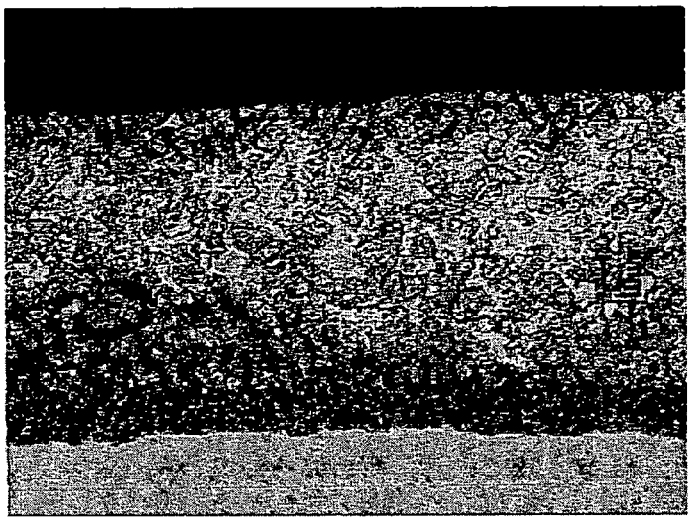
FIG. 5A is a photomicrograph of a cross section of a plated steel wire obtained by water-cooling in Example 5.
Figure 5B:
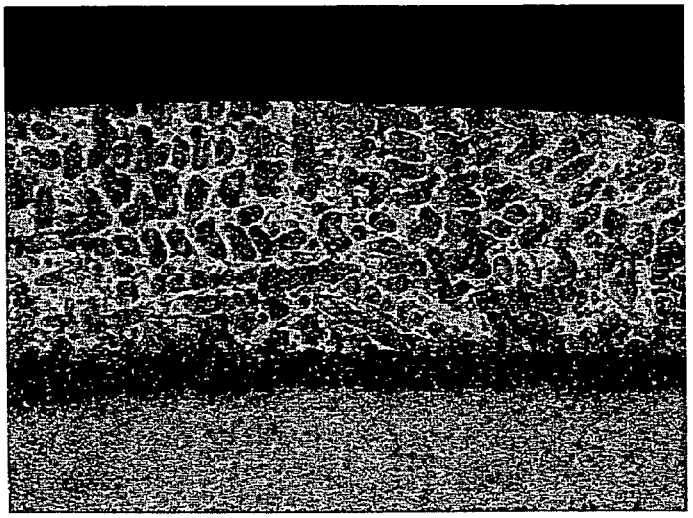
FIG. 5B is a photomicrograph of a cross section of a plated steel wire obtained by air-cooling in Example 5.

FIG. 4A is a photomicrograph of a cross-sectional surface of a plated steel wire obtained by water-cooling in Example 4. FIG. 4B is a photomicrograph of a cross-sectional surface of a plated steel wire obtained by air-cooling in Example 4. FIG. 5A is a photomicrograph of a cross-sectional surface of a plated steel wire obtained by water-cooling in Example 5. FIG. 5B is a photomicrograph of a cross-sectional surface of a plated steel wire obtained by air-cooling in Example 5. In the plated layer of each of these plated steel wires, masses of eutectoid dispersed were observed. With respect to the plated layer in the obtained plated steel wire, composition analysis was conducted.

For the composition analysis, an ICP (high frequency inductively-coupled plasma spectrometer) was used. The results of the composition analysis of the plated layer and the intermediate layer in the obtained plated steel wire are shown in Table 1. In Table 1, the detected metals are represented by the respective atomic symbols, and the ratio of zinc (Zn) are simply displayed as "rest", which means that the zinc content is the main remainder of the content other than contents of the other metals listed.

COMPARATIVE EXAMPLES 1-8

In each of Comparative Examples 1-6, a plating bath composition was prepared by adding a predetermined amount of a metal shown in Table 1 to a zinc-aluminum molten composition containing 11.8 percentage by mass of aluminum, so that the plating bath composition contains metal additives in the ratio shown in Table 1. In Comparative Example 7, a plating bath composition containing no manganese (i.e. the above-mentioned 11.8% aluminum-zinc molten composition) was prepared, and in Comparative Example 8, a plating bath composition containing no manganese or aluminum (i.e. 99.9% molten zinc) was prepared.

Substantially the same procedure as in Examples 1-5 was repeated to produce a plated steel wire, except that these plating bath compositions were used instead of the compositions mentioned in Examples 1-5.

Figure 6A:
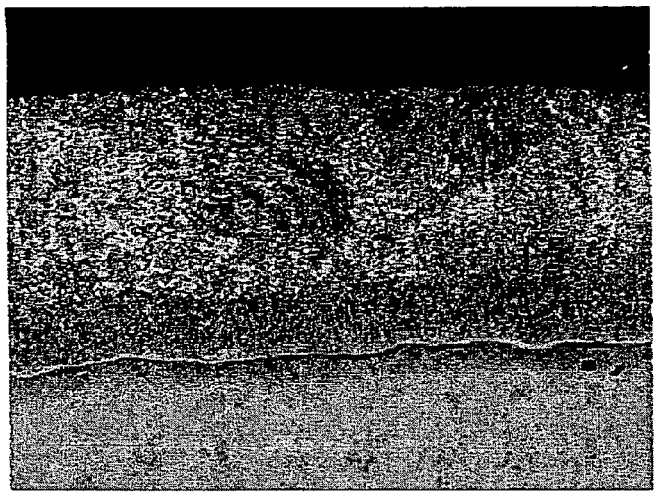
FIG. 6A is a photomicrograph of a cross section of a plated steel wire obtained by water-cooling in Comparative Example 7.
Figure 6B:
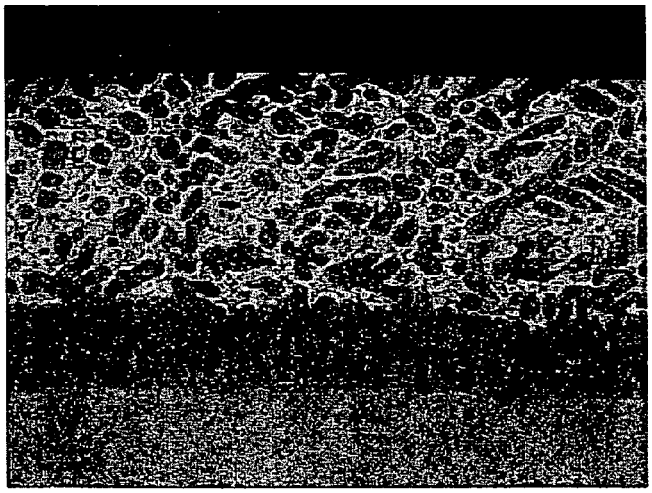
FIG. 6B is a photomicrograph of a cross section of a plated steel wire obtained by air-cooling in Comparative Example 7.

FIG. 6A is a photomicrograph of a cross-sectional surface of a plated steel wire obtained by water-cooling in Comparative Example 7. FIG. 6B is a photomicrograph of a cross-sectional surface of a plated steel wire obtained by air-cooling in Comparative Example 7. In the case of the plated steel wire obtained by air-cooling, masses of eutectoid that were dispersed in the plated layer were observed, while in the case of the plated steel wire obtained by water-cooling, fine particles of eutectoid were dispersed in the plated layer.

The composition analysis of the plated layer of the obtained plated steel wire was conducted in the same manner as in Examples 1-5. The results are shown in Table 1.

<Corrosion Resistance Test>

Onto each of the plated steel wires obtained Examples 1-5 and Comparative Examples 1-8, an aqueous solution of sodium chloride (salt water) having a concentration of 50±5 g/L was sprayed for 500 hours, and after that period of time, corrosion loss of plated layer in each plated steel wire was measured. The result is shown as "salt-spray test, (500H, corrosion loss of plating)" in Table 1. In Table 1, each cell on a column indicated with "$g/m^2$" shows a loss amount of plated layer per unit area of the steel wire surface. Each cell on a column indicated with "%" shows a ratio of the loss amount of the plated layer of the plated steel wire, provided that the loss amount of the plated layer is taken as 100% when the same test is applied to the plated steel wire obtained by water-cooling in Comparative Example 7 (plated steel wire having an aluminum-zinc alloy plated layer with no manganese).

TABLE 1

| | | Content of metal additive in plating bath composition (% by mass) | Composition of plated layer and intermediate layer (% by mass) | | | | | | Salt-spray test (500H, corrosion loss of plating) | | | | |
|---|---|---|---|---|---|---|---|---|---|---|---|---|---|
| | | | | | | | | | Water-cooling | | Air-cooling | | Metal additive |
| | | | Sn | Mg | Mn | Si | Al | Zn | g/m$^2$ | % | g/m$^2$ | % | |
| Examples | 1 | Mn: 0.04% | — | — | 0.02 | — | 11.9 | rest | 45.1 | 80 | 39.0 | 69 | Mn |
| | 2 | Mn: 0.1% | — | — | 0.03 | — | 12.0 | rest | 30.0 | 53 | 34.1 | 60 | |
| | 3 | Mn: 0.3% | — | — | 0.09 | — | 11.9 | rest | 33.2 | 59 | 37.3 | 66 | |
| | 4 | Mn: 0.5% | — | — | 0.21 | — | 12.1 | rest | 28.1 | 50 | 38.6 | 68 | |
| | 5 | Mn: 0.65% | — | — | 0.30 | — | 11.8 | rest | 36.2 | 64 | 40.1 | 70 | |
| Comparative Examples | 1 | Sn: 0.5% | 0.48 | — | — | — | 11.8 | rest | 22.2 | 39 | 20.3 | 36 | Sn |
| | 2 | Mg: 0.5% | — | 0.46 | — | — | 12.0 | rest | 10.6 | 19 | 10.2 | 18 | Mg |
| | 3 | Mn: 0.93% | — | — | 0.46 | — | 12.0 | rest | 39.9 | 71 | 43.2 | 76 | Mn |
| | 4 | Si: 0.1% | — | — | — | 0.07 | 12.2 | rest | 49.1 | 87 | 58.7 | 104 | Si |
| | 5 | Si: 0.3% | — | — | — | 0.27 | 12.1 | rest | 46.3 | 82 | 60.2 | 107 | |
| | 6 | Si: 0.5% | — | — | — | 0.46 | 11.9 | rest | 56.5 | 100 | 46.7 | 82 | |
| | 7 | — | — | — | — | — | 11.8 | rest | 56.5 | 100 | 41.3 | 73 | Not added |
| | 8 | — | — | — | — | — | — | 99.9 | 157 | 279 | 143 | 253 | — |

<Workability Test>

With respect to each of the plated steel wires obtained in Examples 1-5 and Comparative Examples 1-8, workability test was conducted. This workability test was conducted by coiling the plated steel wire eight turns around the same plated steel wire and observing the surface condition of the coiled plated steel wire. Based on the crack condition on the surface of the plated steel wire, the plated steel wires were classified (criteria are shown below).

micro: crack that cannot be recognized by the naked eye but can be barely recognized with the use of 15 power magnifier small: crack that can be barely recognized by the naked eye middle: crack that can be easily recognized by the naked eye large: crack that would catch finger nail peeling: crack that causes peeling of plated layer In this workability test, 10 plated steel wires were tested for each of Examples 1-5 and Comparative Examples 1-8. The plated steel wires were classified into the above-mentioned categories, and the numbers of the plated steel wires for each category are displayed in Table 2. In Table 2, plated steel wires having cracks that fall in the categories of "middle" "large" and "peeling" are considered as defective, and percent defective was calculated for each of Examples and Comparative Examples. The results are shown in Table 2 as "percent defective."

TABLE 2

| | | Water-cooling Type of cracks | | | | | | Air-cooling Type of cracks | | | | | | |
|---|---|---|---|---|---|---|---|---|---|---|---|---|---|---|
| | | micro | small | medium | large | peeling | Percent defective | micro | small | medium | large | peeling | Percent defective | Mental additive |
| Examples | 1 | 8 | 2 | 0 | 0 | 0 | 0 | 7 | 3 | 0 | 0 | 0 | 0 | Mn |
| | 2 | 8 | 2 | 0 | 0 | 0 | 0 | 6 | 4 | 0 | 0 | 0 | 0 | |
| | 3 | 6 | 4 | 0 | 0 | 0 | 0 | 8 | 2 | 0 | 0 | 0 | 0 | |
| | 4 | 6 | 4 | 0 | 0 | 0 | 0 | 7 | 3 | 0 | 0 | 0 | 0 | |
| | 5 | 6 | 4 | 0 | 0 | 0 | 0 | 8 | 2 | 0 | 0 | 0 | 0 | |
| Comparative Examples | 1 | 3 | 4 | 1 | 1 | 1 | 30 | 2 | 3 | 2 | 2 | 1 | 50 | Sn |
| | 2 | 3 | 3 | 3 | 1 | 0 | 40 | 2 | 2 | 3 | 3 | 0 | 60 | Mg |
| | 3 | 0 | 9 | 1 | 0 | 0 | 10 | 5 | 5 | 0 | 0 | 0 | 0 | Mn |
| | 4 | 3 | 0 | 2 | 2 | 3 | 70 | 4 | 0 | 0 | 1 | 5 | 60 | Si |
| | 5 | 3 | 2 | 2 | 1 | 1 | 40 | 5 | 1 | 0 | 1 | 4 | 50 | |
| | 6 | 0 | 3 | 1 | 3 | 3 | 70 | 0 | 0 | 2 | 3 | 5 | 100 | |
| | 7 | 10 | 0 | 0 | 0 | 0 | 0 | 9 | 1 | 0 | 0 | 0 | 0 | Not added |
| | 8 | 10 | 0 | 0 | 0 | 0 | 0 | 9 | 1 | 0 | 0 | 0 | 0 | — |

<Evaluation of Corrosion Resistance of Plated Steel Wire>

As is apparent from Table 1, regardless of the cooling method (water-cooling or air-cooling), the plated steel wires obtained in Examples 1-5 showed less corrosion loss than the plated steel wire of Comparative Example 7 having a plated layer composed of 11.8% aluminum-zinc alloy (containing no manganese). In short, the present invention is excellent in corrosion resistance as compared with the conventional plated steel wires. In the case of the plated steel wire of Comparative Example 8 having a plated layer composed of zinc and the plated steel wires of Comparative Examples 4-6 having a plated layer containing silicon (Si) as a metal additive, corrosion resistance was poor as compared with the plated steel wire of Examples 1-5 (embodiments consistent with the present invention).

In the case of the plated steel wire having a plated layer containing tin (Sn) (Comparative Example 1) and the plated steel wire having a plated layer containing magnesium (Mg) (Comparative Example 2), the plated steel wires obtained by water-cooling showed poorer corrosion resistance than those obtained by air-cooling. In contrast, the plated steel wires of Examples 1-5 obtained by water-cooling showed improved corrosion resistance as compared with those obtained by air-cooling. The plated steel wires of Comparative Example 1 obtained either by water-cooling or air-cooling had dim, leaden appearance with no gloss.

<Evaluation of Workability of Plated Steel Wire>

As is apparent from Table 2, the plated steel wires of Examples 1-5 obtained either by water-cooling or air-cooling had percent defective of 0%, and had excellent workability. In contrast, in the case of the plated steel wire having a plated layer containing tin (Sn) (Comparative Example 1), those obtained by water-cooling and by air-cooling had percent defective of 30% and 50%, respectively. In the case of the plated steel wire having a plated layer containing magnesium (Mg) (Comparative Example 2), those obtained by water-cooling and by air-cooling had percent defective of 40% and 60%, respectively. In the case of the plated steel wire having a plated layer containing silicon (Si) (Comparative Examples 4, 5 and 6), those obtained by water-cooling and by air-cooling had percent defective of 40% or more and 50% or more, respectively. The plated steel wire having a plated layer with manganese (Mn) content of more than 0.30% (Comparative Example 3) had percent defective of 10%.

<Discussion of Corrosion Resistance and Workability of Plated Steel Wire>

The plated steel wires of Examples 1-5, obtained either by water-cooling or by air-cooling, have excellent corrosion resistance and workability. Consequently, these plated steel wires are suitable as a material for wire netting products, especially those used outdoors.

In addition, the plated steel wires of Examples 1-5 obtained even by water-cooling have excellent corrosion resistance. In other word, water-cooling can be applied to the plated steel wire production device, and the height position of the top roller can be set low as mentioned above, which allows downsizing of the plated steel wire production device. This downsizing of the plated steel wire production device in turn facilitates workability of setting the wire.

<Evaluation of Concentration Distribution of Metal Additive in Plated Layer and Intermediate Layer of Plated Steel Wire>

Figure 7:
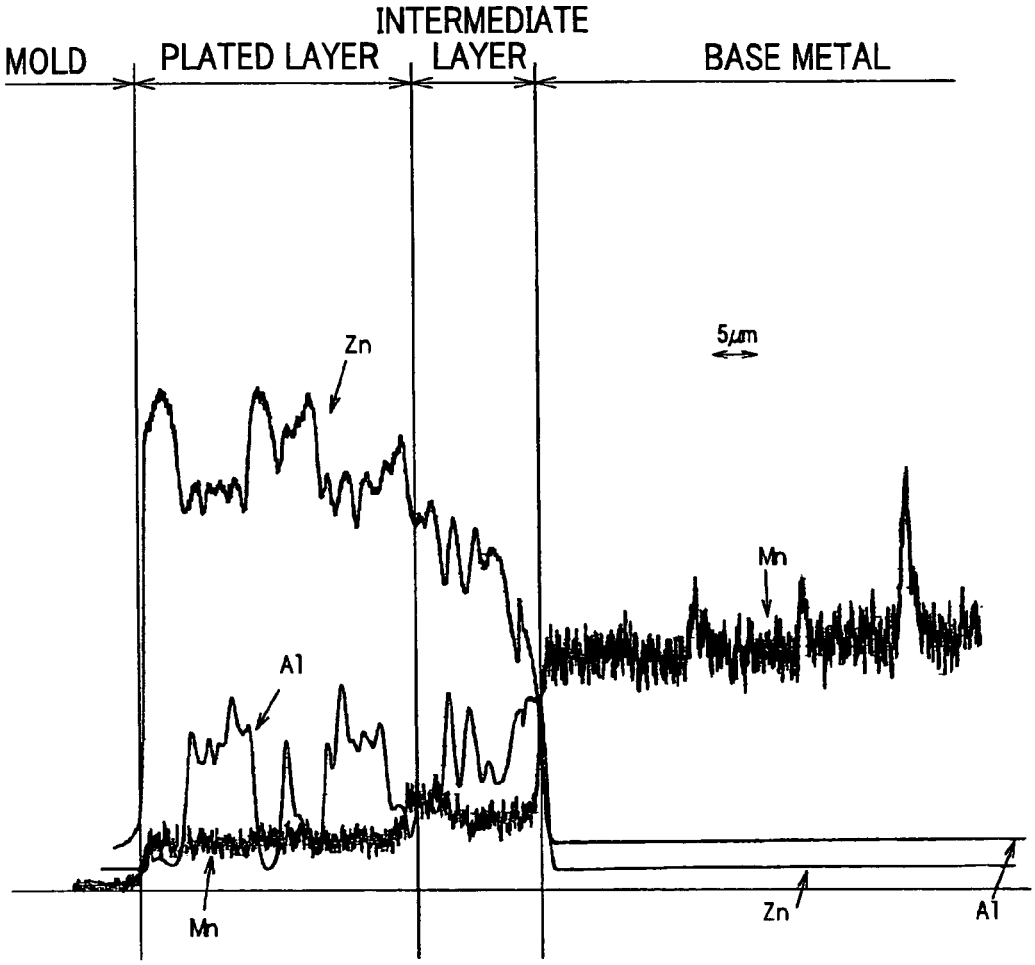
FIG. 7 is a chart showing a concentration distribution of metals in a plated steel wire of Example 4, in the case where the metal additive is manganese.
Figure 8:
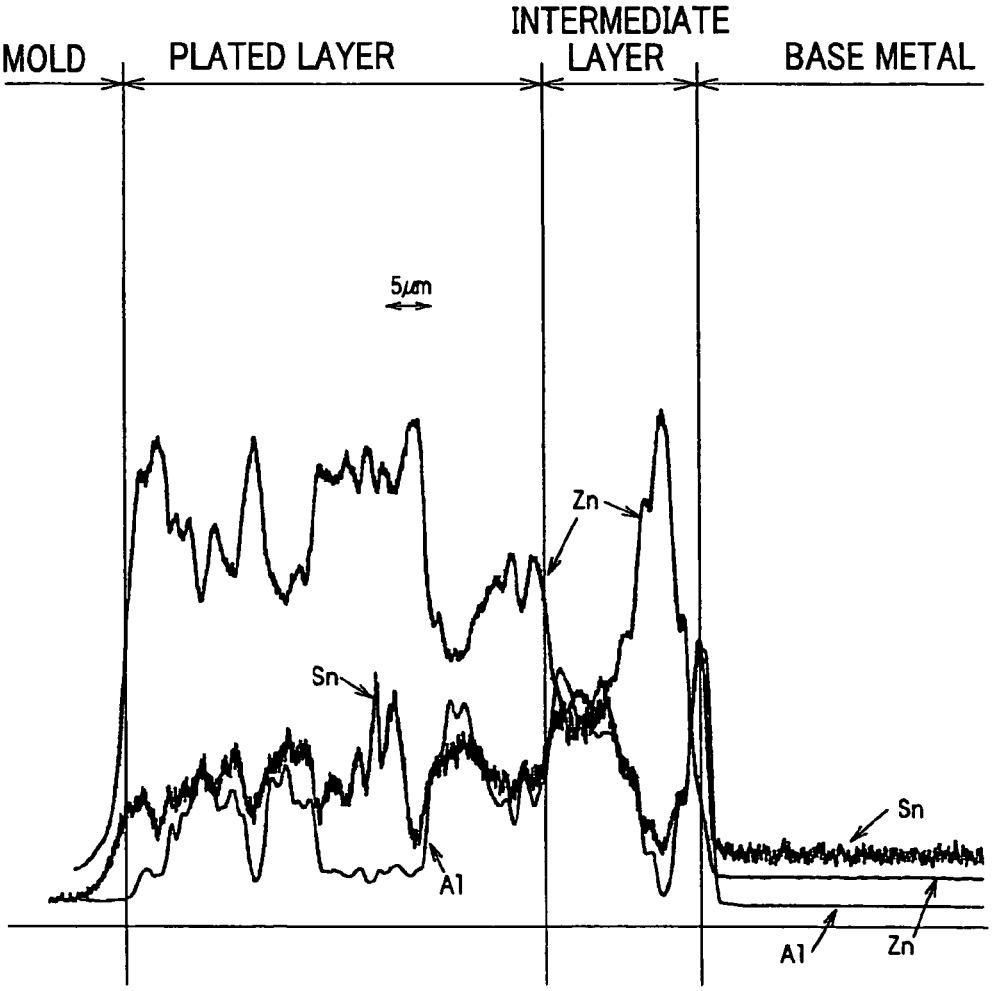
FIG. 8 is a chart showing a concentration distribution of metals in a plated steel wire of Comparative Example 1, in the case where the metal additive is tin.
Figure 9:
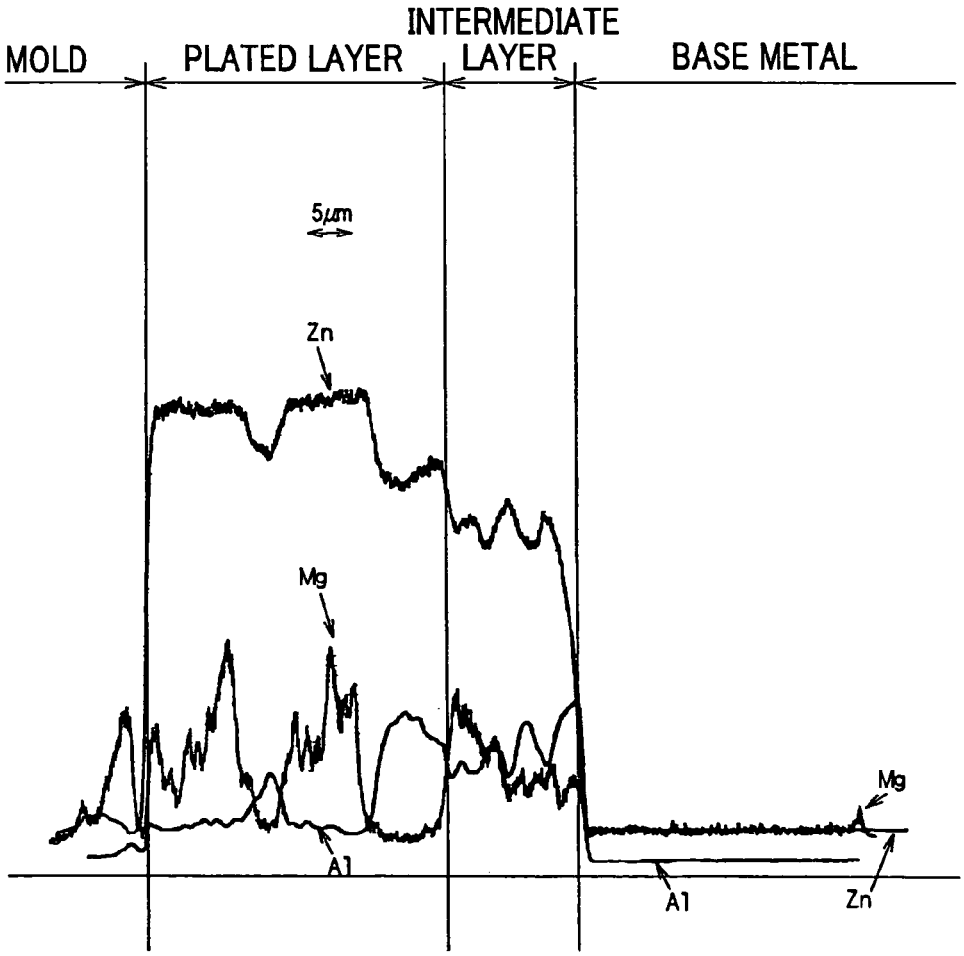
FIG. 9 is a chart showing a concentration distribution of metals in a plated steel wire of Comparative Example 2, in the case where the metal additive is magnesium.
Figure 10:
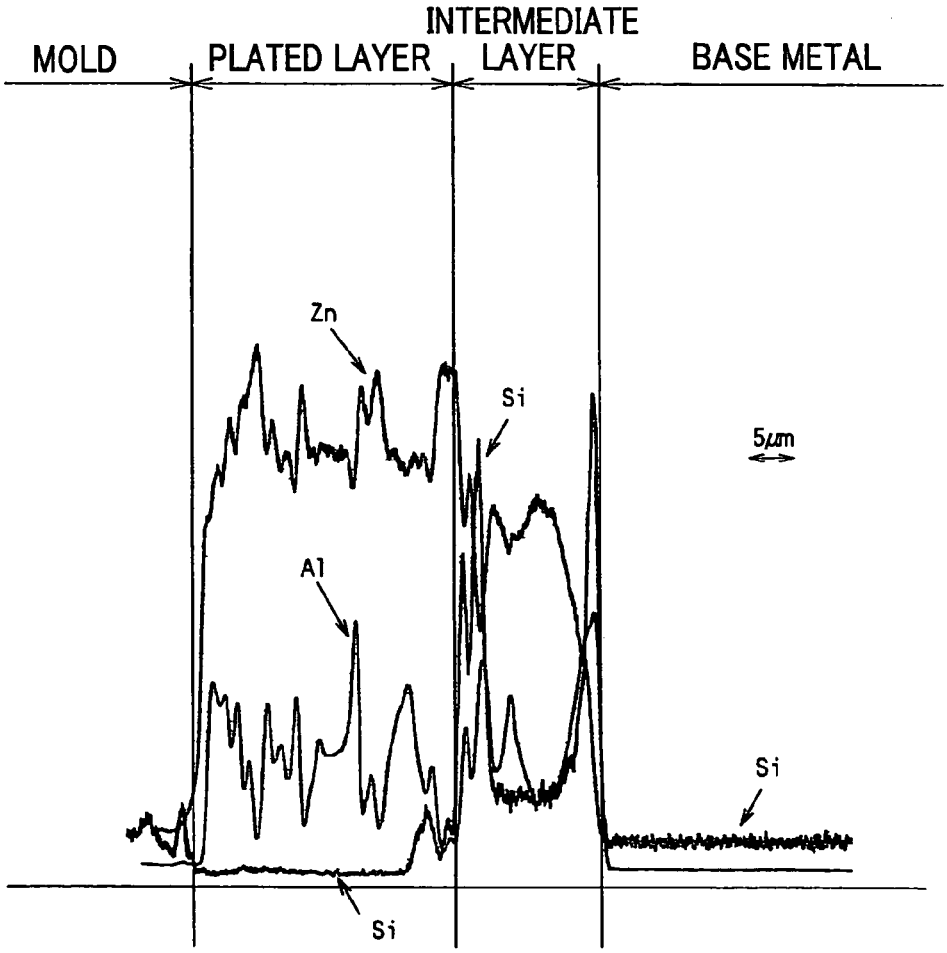
FIG. 10 is a chart showing a concentration distribution of metals in a plated steel wire of Comparative Example 5, in the case where the metal additive is silicon.

Next, with respect to each of the plated steel wire obtained by air-cooling in Example 4 [0.21% Mn-12.1% Al-87.69% (Zn and inevitable components) plated steel wire], the plated steel wire obtained by water-cooling in Comparative Example 1 [0.48% Sn-11.8% Al-87.72% (Zn and inevitable components) plated steel wire], the plated steel wire obtained by water-cooling in Comparative Example 2 [0.46% Mg-12.0% Al-87.54% (Zn and inevitable components) plated steel wire] and the plated steel wire obtained by air-cooling in Comparative Example 5 [0.27% Si-12.1% Al-87.63% (Zn and inevitable components) plated steel wire], concentration distribution of each metal additive (Example 4: manganese (Mn), Comparative Example 1: tin (Sn), Comparative Example 2: magnesium (Mg) and Comparative Example 5: silicon (Si)) in the plated layer and the intermediate layer was measured. For measurement, an EPMA (X-ray microanalyzer) was used. In this EPMA, accelerating voltage was set to20 kV; sample current to 30 nA; and beam diameter to 1 μm. FIG. 7 is a chart showing a concentration distribution of metals in the plated steel wire of Example 4, in the case where the metal additive is manganese. FIG. 8 is a chart showing a concentration distribution of metals in the plated steel wire of Comparative Example 1, in the case where the metal additive is tin. FIG. 9 is a chart showing a concentration distribution of metals in the plated steel wire of Comparative Example 2, in the case where the metal additive is magnesium. FIG. 10 is a chart showing a concentration distribution of metals in the plated steel wire of Comparative Example 5, in the case where the metal additive is silicon.

As shown in FIG. 7, the metal additive (manganese) in the plated steel wire of Example 4 is homogeneously dispersed in the plated layer and the intermediate layer. In contrast, in the case of the plated steel wires of Comparative Examples 1, 2 and 5, the concentrations of the metal additives (tin (Sn), magnesium (Mg) and silicon (Si), respectively) are heterogeneous in the plated layer and the intermediate layer, as shown in FIGS. 8, 9 and 10, respectively.

Since the concentration of the metal additive (manganese) in the plated steel wire of Example 4 is homogeneous throughout the plated layer and the intermediate layer, the plated steel wire has excellent workability as described above.

EXAMPLE 6 AND COMPARATIVE EXAMPLE 9; AND EXAMPLE 7 AND COMPARATIVE EXAMPLE 10

In each of Example 6, Comparative Example 9, Example 7 and Comparative Example 10, fifty sets of the plating bath composition containing aluminum (Al), manganese (Mn) and zinc (Zn) in various ratios selected from the range shown in Table 3, which will be described below, were prepared.

An iron wire on which 10% of aluminum and 90% of zinc had been plated was used as a steel wire. This steel wire was immersed for 8 seconds in the plating bath composition prepared in advance (bath temperature: 450° C.), and pulled out from the plating bath. The pull-out speed of the steel wire (linear velocity of plating) was set to 60 m/min in Example 6 and Comparative Example 9 and to 55 m/min in Example 7 and Comparative Example 10. In each of Examples and Comparative Examples, the steel wire on which the plating bath composition was deposited was subjected to water-cooling, to thereby obtain a plated steel wire. In Example 6 and Comparative Example 9, a steel wire having a diameter of 4.0 mm was used, while in Example 7 and Comparative Example 10, a steel wire having a diameter of 5.0 mm was used.

With respect to the plated layer and the intermediate layer of each of the obtained plated steel wires, composition analysis was conducted. For the composition analysis, an ICP (high frequency inductively-coupled plasma spectrometer) was used. The results of composition analysis of the plated layer and the intermediate layer in the obtained plated steel wire are shown in Table 3. In Table 3, the ratio of zinc (Zn) is simply displayed as "rest", which means that the zinc content is the main remainder of the content other than contents of the other metals listed.

TABLE 3

| | Diameter of the wire rod (mm) | Mn Addition | Composition of plated layer and intermediate layer (% by mass) Al | Mn | Zn | Component of plating bath composition (% by mass) Al | Mn | Zn | Linear velocity of plating (m/min) | Deposition amount ($g/m^2$) Average deposition amount | Minimum deposition amount | Maximum deposition amount |
|---|---|---|---|---|---|---|---|---|---|---|---|---|
| Example 6 | 4.0 | Yes | 10.7~12.4 | 0.03~0.06 | rest | 9.0~10.8 | 0.07~0.18 | rest | 60 | 805 | 701 | 926 |
| Comparative Example 9 | 4.0 | No | 10.6~12.0 | 0 | rest | 9.2~10.2 | 0 | rest | 60 | 706 | 683 | 749 |
| Example 7 | 5.0 | Yes | 10.3~12.1 | 0.03~0.08 | rest | 9.1~10.2 | 0.11~0.20 | rest | 55 | 820 | 710 | 986 |
| Comparative Example 10 | 5.0 | No | 10.5~11.9 | 0 | rest | 9.0~9.9 | 0 | rest | 55 | 720 | 686 | 761 |

<Evaluation of Deposition Amount of Plated Layer and Intermediate Layer>

Next, with respect to each of the obtained plated steel wires, total deposition amount of the plated layer and the intermediate layer was measured. The results are shown in Table 3. The deposition amount is displayed as a total amount of the plated layer and the intermediate layer per unit area of the steel wire surface, and measured in accordance with JIS H0401. It should be noted that, in each Examples and Comparative Examples, the maximum deposition amount in table 3 is the largest deposition amount obtained among 50 wires prepared, while the minimum deposition amount is the smallest deposition amount obtained among 50 wires prepared. The average deposition amount was obtained by averaging the deposition amounts (total deposition amount of the plated layer and the intermediate layer) of 50 plated steel wires.

As is apparent from Table 3, the plated steel wires of Examples 6 and 7 have more plated layer and intermediate layer deposited thereon by approximately 100 $g/m^2$ than the plated steel wires of Comparative Examples 9 and 10 have. The maximum deposition amount of the plated steel wire of Example 7 was 986 $g/m^2$.

<Discussion of Deposition Amount on Plated Steel Wire>

In the plated steel wires of Examples 6 and 7 (having a plated layer containing manganese), the total deposition amount of the plated layer was remarkably augmented as compared with the conventional plated steel wires which do not contain manganese (for example, see the plated steel wire of Comparative Examples 9 and 10). Because of the increased deposition amount, the plated steel wires of Examples 6 and 7 showed improved corrosion resistance as compared with conventional plated steel wires. It is inferred that the reason for the increased deposition amount of the plated layer of the plated steel wire of Examples 6 and 7 is that fluidity of the plating bath composition is lowered due to the presence of manganese therein.

(Measurement of Hardness of Plated Layer and Intermediate Layer)

Next, Vickers hardness (Hv) of the plated layer and the intermediate layer of the plated steel wire was measured. For the measurement, manganese, magnesium or silicon was added to zinc-aluminum molten composition containing 11.8% by mass of aluminum so that the added metal is contained in the predetermined ratios shown in Table 4 below, to thereby prepare plating bath compositions A1-A4, B1-B4 and C1-C3 for Mn, Mg and Si, respectively.

TABLE 4

| | | Content of metal additive in plating bath composition (% by mass) | Metal additive |
|---|---|---|---|
| Plating bath composition | A1 | Mn: 0.04% | Mn |
| | A2 | Mn: 0.1% | |
| | A3 | Mn: 0.3% | |
| | A4 | Mn: 0.65% | |
| | B1 | Mg: 0.1% | Mg |
| | B2 | Mg: 0.15% | |
| | B3 | Mg: 0.3% | |
| | B4 | Mg: 0.8% | |
| | C1 | Si: 0.1% | Si |
| | C2 | Si: 0.3% | |
| | C3 | Si: 0.5% | |
| | D | — | Not added |

Figure 11:
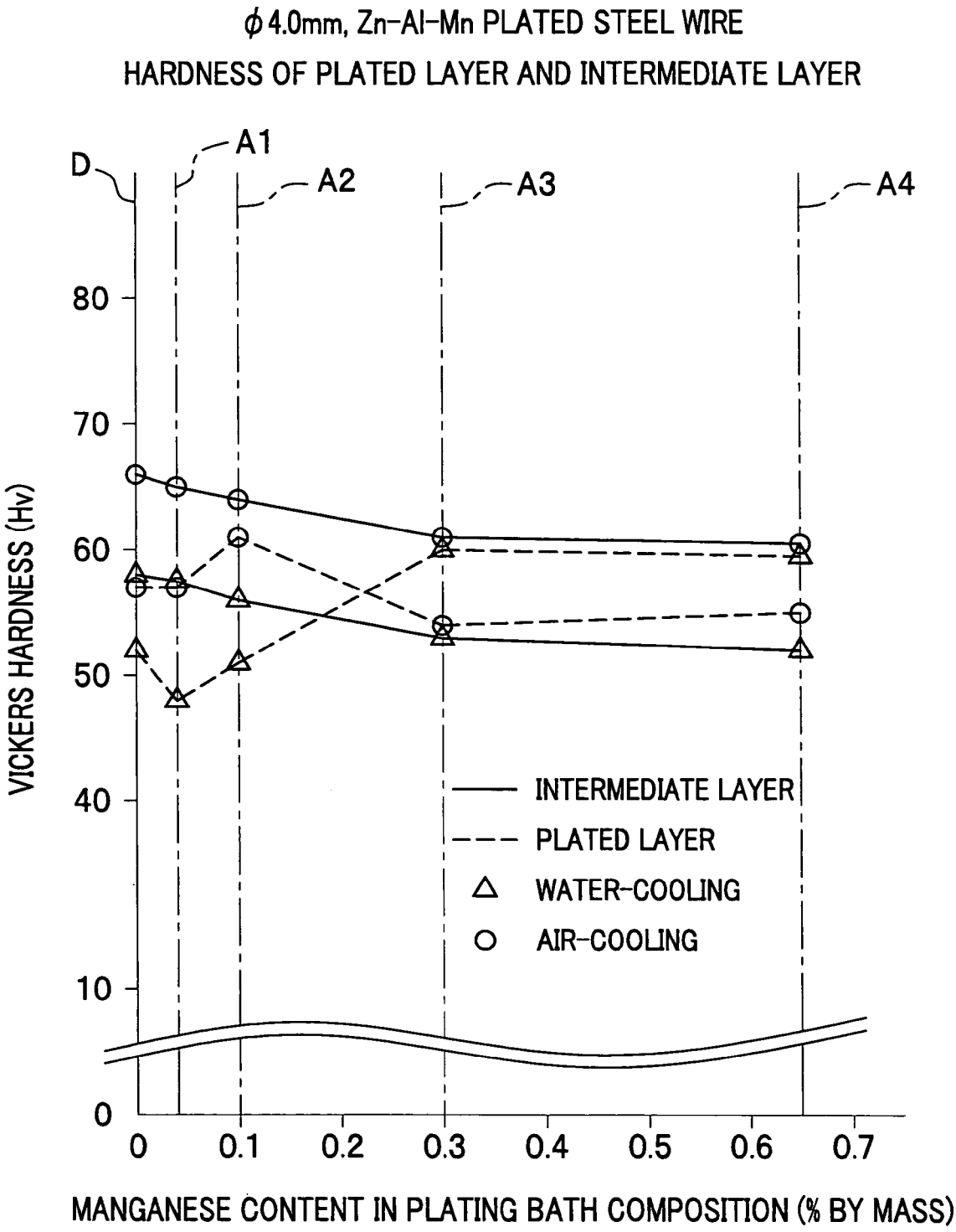
FIG. 11 is a graph showing the relationships between the manganese (Mn) content (percentage by mass) in the plating bath composition and the Vickers hardness (Hv), with respect to the plated layer and the intermediate layer, obtained either by air-cooling or by water-cooling.
Figure 12:
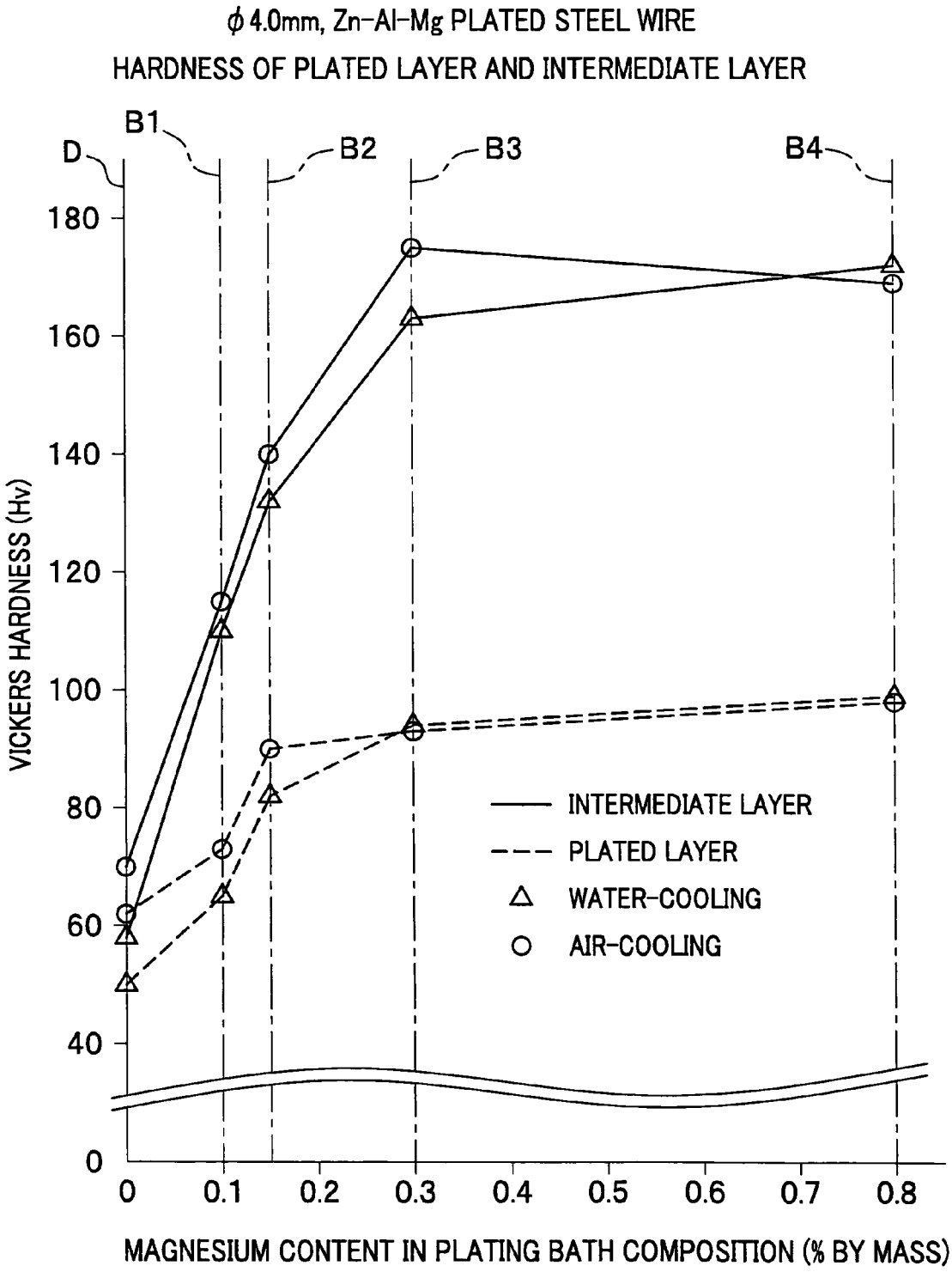
FIG. 12 is a graph showing the relationships between the magnesium (Mg) content (percentage by mass) in the plating bath composition and the Vickers hardness (Hv), with respect to the plated layer and the intermediate layer, obtained either by air-cooling or by water-cooling.
Figure 13:
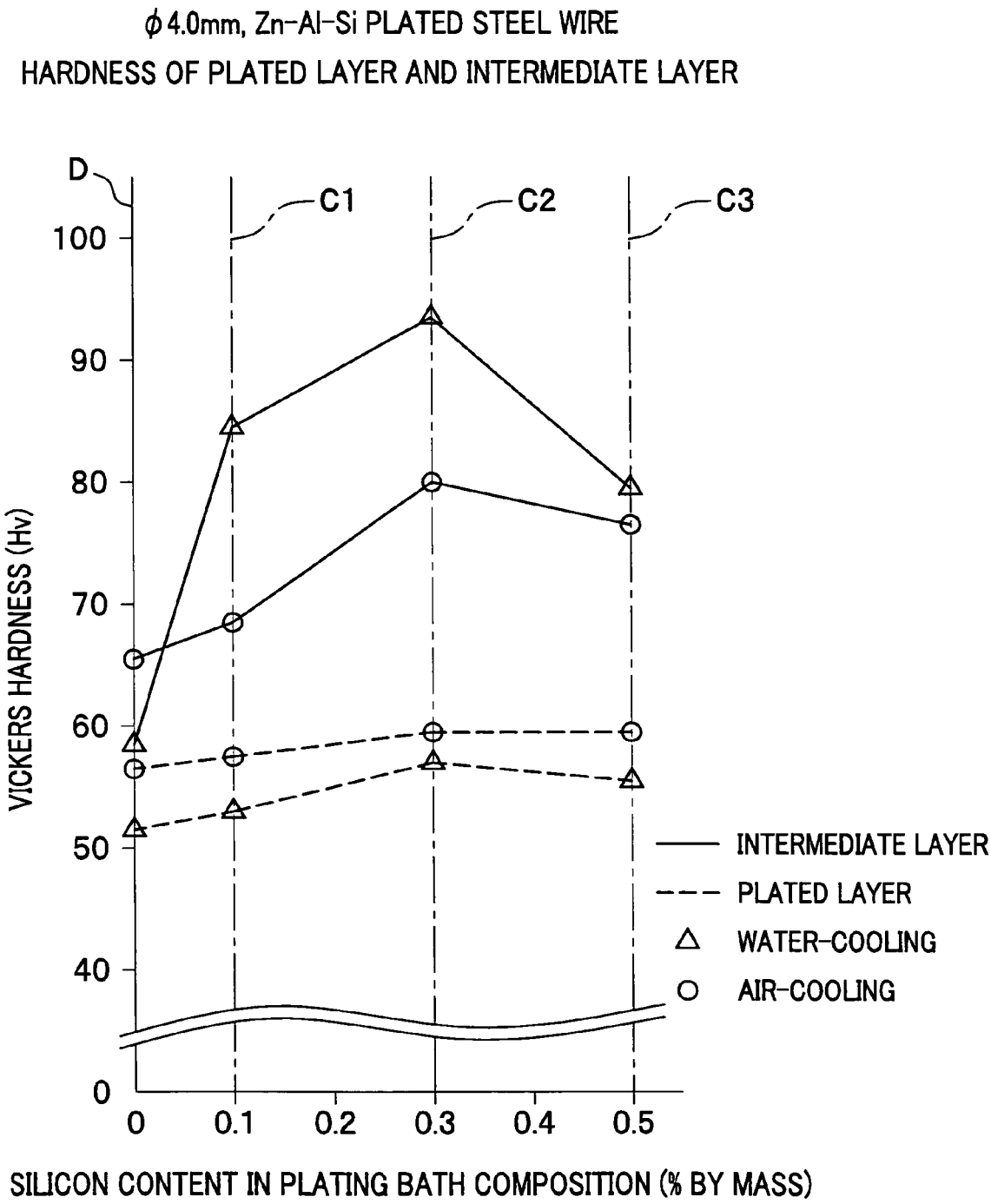
FIG. 13 is a graph showing the relationships between the silicon (Si) content (percentage by mass) in the plating bath composition and the Vickers hardness (Hv), with respect to the plated layer and the intermediate layer, obtained either by air-cooling or by water-cooling.

An iron wire on which zinc had been deposited as a primary plating was used as a steel wire (diameter: 4.0 mm). This steel wire was immersed for 8 seconds in the plating bath composition prepared in advance, and pulled out from the plating bath. Subsequently, two different types of plated steel wires on which the plating bath composition was deposited were prepared, either by air-cooling or water-cooling. With respect to each of the plated layer and the intermediate layer of these plated steel wires, Vickers hardness (Hv) was measured. The results are shown in FIGS. 11-13. FIG. 11 is a graph showing the relationships between the manganese (Mn) content (percentage by mass) in the plating bath composition and the Vickers hardness (Hv), with respect to the plated layer and the intermediate layer, obtained either by air-cooling or by water-cooling. FIG. 12 is a graph showing the relationships between the magnesium (Mg) content (percentage by mass) in the plating bath composition and the Vickers hardness (Hv), with respect to the plated layer and the intermediate layer, obtained either by air-cooling or by water-cooling. FIG. 13 is a graph showing the relationships between the silicon (Si) content (percentage by mass) in the plating bath composition and the Vickers hardness (Hv), with respect to the plated layer and the intermediate layer, obtained either by air-cooling or by water-cooling. In FIGS. 11-13, the axis D indicates the hardness of the plated layer and the hardness of the intermediate layer of the plated steel wire obtained using a plating bath composition containing no metal additives (manganese, magnesium and silicon).

<Evaluation and Discussion of Hardness of Plated Layer and Intermediate Layer>

As is apparent from FIG. 11, in the case of the plated steel wires obtained using a plating bath composition containing manganese either by air-cooling or by water-cooling, the plated layer has Vickers hardness of 45-65; and the intermediate layer has Vickers hardness of 50-70. In other words, the plated steel wire obtained using the plating bath composition containing manganese (present invention) had the plated layer and the intermediate layer which were approximate to each other in Vickers hardness. For example, in the case of 0.3% manganese-containing plating bath composition (A3), the difference in hardness between the plated layer and the intermediate layer was less than 10.

In contrast, as is apparent from FIG. 12, in the case of the plated steel wires obtained using the plating bath composition containing magnesium of, for example, 0.3% content (B3) either by air-cooling or by water-cooling, the difference in Vickers hardness between the plated layer and the intermediate layer was approximately 80.

As is apparent from FIG. 13, in the case of the plated steel wire obtained using the plating bath composition containing silicon of, for example, 0.3% content (C2) by air-cooling, the difference in Vickers hardness between the plated layer and the intermediate layer was approximately 20. In the case of the plated steel wire obtained using the plating bath composition containing silicon of, for example, 0.3% content (C2) by water-cooling, the difference in Vickers hardness between the plated layer and the intermediate layer was approximately 40.

In short, it is inferred that the reason for excellent workability exhibited by the plated steel wire obtained by the plating bath composition containing manganese (embodiments consistent with the present invention) is that Vickers hardness of the plated layer is approximate to that of the intermediate layer and at the same time the values thereof are low.

Next, with respect to the plating bath composition containing manganese, fluidity evaluation test was conducted as Referential Examples.

REFERENTIAL EXAMPLES 1-3

In each of Referential Examples 1-3, a predetermined ratio of manganese (Mn) was added to a zinc-aluminum molten composition containing 11.8% by mass of aluminum, to thereby prepare a molten metal (temperature: 450° C.) as a plating bath composition containing aluminum (Al) and manganese (Mn) in the ratios shown in Table 5 below, as well as zinc as the remainder (though not shown in Table 5). With respect to the molten metal, fluidity evaluation test was conducted.

<Fluidity Evaluation Test>

Figure 14A:
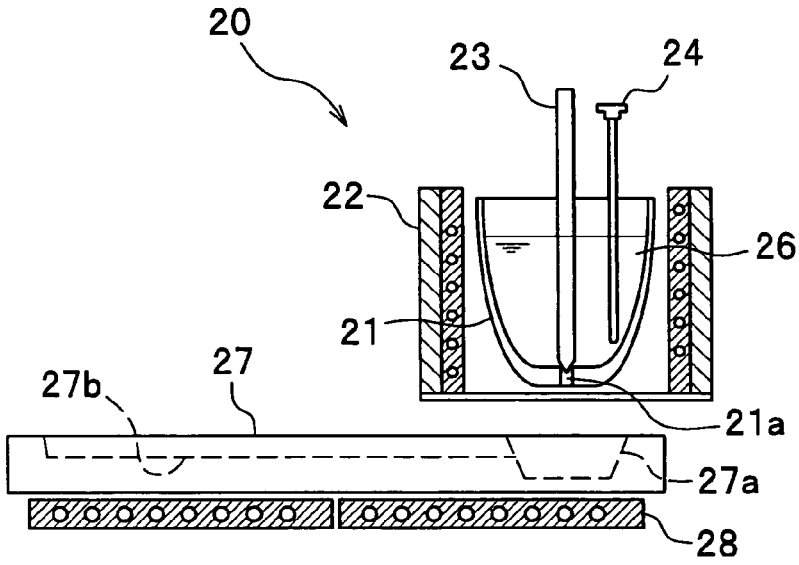
FIG. 14A is a diagram explaining a test device used for fluidity evaluation test of a plating bath composition containing manganese.
Figure 14B:
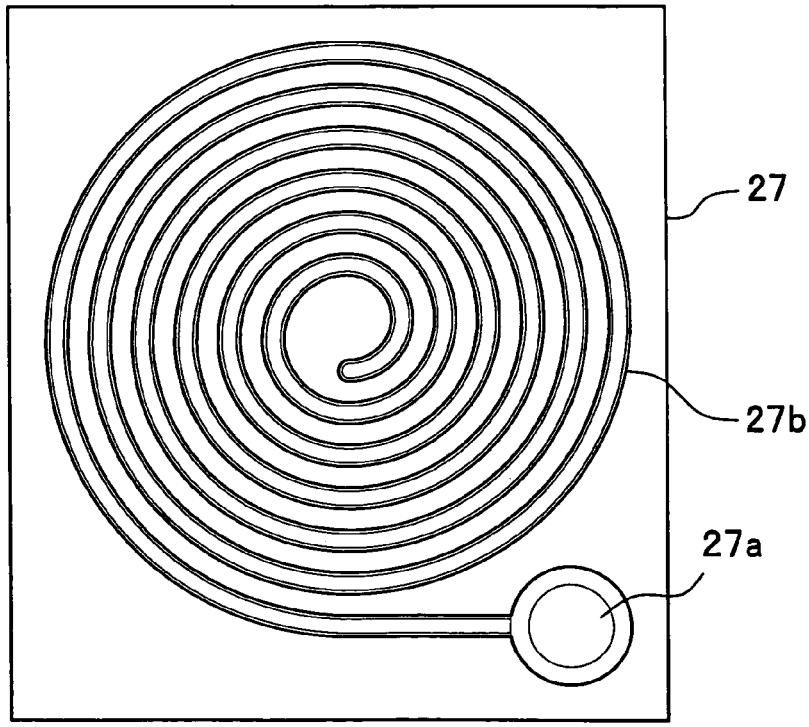
FIG. 14B is a top view of a spiral mold forming a part of the test device of FIG. 14A.

In this fluidity evaluation test, a test device 20 shown in FIGS. 14A and 14B was used. FIG. 14A is a diagram explaining the test device 20. FIG. 14B is a top view of a spiral mold 27 forming a part of the test device 20.

This test device 20 includes, as shown in FIG. 14A, a graphite crucible 21 to which the above-mentioned molten metal 26 is introduced; an electric heater furnace 22 for heating the graphite crucible 21; a spiral mold 27 which is located below the graphite crucible 21; and an electric heater 28 for heating the spiral mold 27 to approximately 200° C.

In this test device 20, the molten metal 26 introduced to the graphite crucible 21 is kept at 450° C. by heating with the electric heater furnace 22 while observing the temperature by a thermocouple 24. By removing the stopper 23 that has blocked a sprue 21*a* formed on the bottom of the graphite crucible 21, the molten metal 26 starts to flow down from the graphite crucible 21 into the spiral mold 27.

As shown in FIG. 14B, the spiral mold 27 includes a molten metal pool 27*a* for receiving the molten metal 26 flowed from the graphite crucible 21; and a groove 27*b* spirally extending from the molten metal pool 27*a*.

In this test device 20, when the molten metal pool 27*a* receives the molten metal 26 at temperature of approximately 450° C., the molten metal 26 enters the groove 27*b* from the molten metal pool 27*a*. The molten metal 26 in the groove 27*b* then starts to flow along the groove 27*b*. Since the spiral mold 27 is set to approximately 200° C., the molten metal 26 flowing along the groove 27*b* is gradually solidified, until it is completely solidified. The length of the molten metal 26 flowed from the molten metal pool 27*a* along the groove 27*b* becomes longer, if the fluidity of the molten metal 26 is higher. For the fluidity evaluation test, by measuring the length of the flowed molten metal 26 (hereinbelow, simply referred to as "flow length"), fluidity of each molten metal 26 prepared in Referential Examples 1-3 was evaluated. The fluidity evaluation test was repeated 10 times for each molten metal 26 in Referential Examples 1-3, and the average flow length was calculated. The results are shown in Table 5.

TABLE 5

| Referential Example | Molten metal temperature (° C.) | Content of metal additive (% by mass) Al | Mn | Average flow length (mm) |
|---|---|---|---|---|
| 1 | 450 | 10.9 | — | 23.5 |
| 2 | | 11.2 | 0.058 | 18.0 |
| 3 | | 11.2 | 0.140 | 16.5 |

As is apparent form Table 5, the fluidity of the molten metal 26 decreased as the manganese (Mn) content increased. In other words, it is inferred that, in Examples 6 and 7, the presence of manganese lowered the fluidity of the plating bath composition, and as a result, the total deposition amount of the plated layer and the intermediate layer on the steel wire was increased.

What is claimed is:

1. A corrosion-resistant and workable plated steel wire comprising: a steel wire; a plated layer comprising zinc, aluminum and manganese; and an intermediate layer comprising zinc, aluminum and manganese, intermediate layer being sandwiched between the steel wire and the plated layer, wherein a content of manganese contained in both the plated layer and the intermediate layer is 0.02-0.30% in terms of average mass percentage, a content of aluminum is 8-25% in terms of average mass percentage, and a content of zinc and inevitable components is 74.70-91.98% in terms of average mass percentage.

2. The plated steel wire according to claim 1, wherein a total deposition amount of the intermediate layer and the plated layer per unit area of the steel wire surface is set to 700-1000 g/m.sup.2.

3. The plated steel wire according to claim 1, wherein the concentration of the manganese is uniform throughout the plated layer and the intermediate layer; Vickers hardness of the plated layer is 45-65; and Vickers hardness of the intermediate layer is 50-70.

4. The plated steel wire according to claim 2, wherein the concentration of the manganese is uniform throughout the plated layer and the intermediate layer; Vickers hardness of the plated layer is 45-65; and Vickers hardness of the intermediate layer is 50-70.

5. The plated steel wire according to claim 1, wherein manganese, aluminum and zinc in the plated layer form masses of eutectoid and the masses are dispersed in a matrix of the plated layer comprising zinc, aluminum and manganese.

6. The plated steel wire according to claim 2, wherein manganese, aluminum and zinc in the plated layer form masses of eutectoid and the masses are dispersed in a matrix of the plated layer comprising zinc, aluminum and manganese.

7. A wire netting product formed of corrosion-resistant and workable plated steel wire according to claim 1.

8. A wire netting product formed of corrosion-resistant and workable plated steel wire according to claim 2.

9. A basket made of wire netting wherein at least an upper face thereof is formed of the corrosion-resistant and workable plated steel wire according to claim 1.

10. A basket made of wire netting wherein at least an upper face thereof is formed of the corrosion-resistant and workable plated steel wire according to claim 2.

* * * * *